US007870972B2

(12) United States Patent
Elefante

(10) Patent No.: US 7,870,972 B2
(45) Date of Patent: Jan. 18, 2011

(54) SLIDING SAFETY HINGE ASSEMBLY FOR LID OF BOX

(76) Inventor: Dennis James Elefante, 9343 Stone Canyon Rd., Corona, CA (US) 92883

( * ) Notice: Subject to any disclaimer, the term of this patent is extended or adjusted under 35 U.S.C. 154(b) by 512 days.

(21) Appl. No.: 12/075,519

(22) Filed: Mar. 11, 2008

(65) Prior Publication Data

US 2008/0237252 A1 Oct. 2, 2008

Related U.S. Application Data

(60) Provisional application No. 60/908,136, filed on Mar. 26, 2007.

(51) Int. Cl.
*B65D 43/16* (2006.01)
*E05D 13/00* (2006.01)
*B65D 51/04* (2006.01)

(52) U.S. Cl. ..... 220/811; 16/242; 16/251; 16/364; 220/813; 220/829; 220/832; 220/845

(58) Field of Classification Search ..... 220/811, 220/829, 813, 828, 845, 832; 16/233, 364, 16/246, 250, 251
See application file for complete search history.

(56) References Cited

U.S. PATENT DOCUMENTS

| | | | | |
|---|---|---|---|---|
| 131,478 | A | 9/1872 | Tice | |
| 311,518 | A * | 2/1885 | Palmer | 16/364 |
| 523,304 | A | 7/1894 | Collins | |
| 2,167,585 | A * | 7/1939 | Mulvaney | 16/364 |
| 2,211,581 | A * | 8/1940 | Ross | 16/364 |
| 2,620,509 | A | 12/1952 | Keating | |
| 3,965,532 | A * | 6/1976 | Wigfall | 16/270 |
| 5,967,392 | A * | 10/1999 | Niemi et al. | 224/404 |
| 6,243,919 | B1 | 6/2001 | Hetland | |
| 6,836,934 | B2 | 1/2005 | De Juana et al. | |
| 7,010,833 | B2 | 3/2006 | Duarte et al. | |
| 2006/0260096 | A1 * | 11/2006 | Fries | 16/246 |

* cited by examiner

*Primary Examiner*—Anthony Stashick
*Assistant Examiner*—Niki M Eloshway
(74) *Attorney, Agent, or Firm*—Kirk A. Buhler; Buhler & Associates

(57) ABSTRACT

The Sliding Safety Hinge Assembly (SSHA) minimizes the degree of personal injury or discomfort that could result from accidental closure of the lid of a box, i.e. "toy box", by pinching a finger between the lid and box, particularly as the obstruction approaches the side or rear of the box near the hinge. A traditional hinge attached to the lid and rear of box carcass provides a fixed pivot point such that a severe pinch point exists due to the leverage of the lid. The SSHA reduces this potential by a sliding design such that the hinge element normally fastened to the rear of the box is rather installed on a slide assembly allowing free sliding motion in the vertical plane at the rear of the box. The SSHA assembly would include a slide, pivot and counter weight device to reduce the weight of the lid.

18 Claims, 3 Drawing Sheets

SLIDING SAFETY HINGE ASSEMBLY FOR LID OF BOX

CROSS REFERENCE TO RELATED APPLICATION

This application claims the benefit of Provisional 60/908,136 filed Mar. 26, 2007 the entire contents of which is hereby expressly incorporated by reference herein.

FIELD OF THE INVENTION

This invention relates to improvements in a hinge. More particularly, the present invention is an enhancement to conventionally produced and applications of a hinge, such as the hinge (s) providing the pivot point between a box and lid. The "enhancement" is the actual idea and the intended improvement in application is to minimize the potential bodily harm that can result from an extremity being pinched between the compressive and/or shearing action of the box and lid upon closure.

BACKGROUND OF THE INVENTION

Most toy box use a standard hinge that pivots through an axis located on one end of the box. If a child places a finger on the outmost end of the toy box away of the hinge side there is minimal load that can crush a finger. If a child places a finger closer to the hinge side mechanical advantage of the moment arm of the lid make crushing or severing a finger easier. Normally the selection of lighter weight material and mechanisms for counter balancing the weight of the lid can be considered and incorporated into the design and fabrication of the box, thus minimizing the likelihood and/or force of the lid accidentally compressing one's extremity (finger/hand). Unfortunately, the force that can be produced between the lid and the box upon closing can be significant when being forcefully closed by an individual and in particular as the pinched extremity approaches the physical plane of the hinges pivot point, as the leverage resulting from this "scissors" action can be tremendous, i.e. magnitudes higher than the weight and/or force being applied to the lid. As a consequence, the victim of this accident can experience bodily injury. Some custom hinge patents have been issued that allow for a sliding end of a hinge. In all these cases the inventor creates a unique hinge while the pending application operates with a standard hinge. Exemplary examples of issue custom hinges are provided herein.

U.S. Pat. No. 523,304 issued on Jul. 17, 1894 to R. F. Collins discloses a furniture hinge. The furniture hinge provides for both an extension and a hinging action for furniture. More specifically the extension allows the hinge to work with a sofa bed where the extension allows the padding on the bed surface to be accommodated. While this patent allows for a sliding hinge that could be used in other applications the hinge is a custom configuration and is not useful with a standard hinge.

U.S. Pat. No. 6,243,919 issued Jun. 12, 2001 to Ove Hetland discloses a hinge for doors and windows. The hinge is custom fabricated and includes a spring that pushes an arm of the hinge into the pivoting hilt of the hinge. This patent is used with vertical surfaces that are maintained in a various positions from open to close. While this patent reduces the potential for injury on a door or window it uses custom hinge pieces and is not intended for use with toy box lids that swing vertically open.

U.S. Pat. No. 6,836,934 issued Jan. 4, 2005 to San Miguel De Juana et al., discloses a safety hinge. The safety hinge mounts on the ends of a door frame. If an object is in the pinch area of the doorjamb springs in the safety hinge allow the safety hinge to move the pivotal axis of the safety hinge. While the safety hinge opens the pinch location the patented safety hinge in entirely custom and is not compatible with standard hinges and or door hardware.

What is needed is a sliding hinge mechanism that operates with a standard hinge to lift the lid of a box to prevent a finger or hand from being crushed. The proposed sliding safety hinge provides this solution with a sliding mechanism that operates with a standard hinge to lift the hinge side of a box to prevent the injury.

BRIEF SUMMARY OF THE INVENTION

It is an object of the sliding safety hinge assembly to operate with standard hinges. One side of a standard hinge mounted to the lid of a toy box or similar enclosure and the other side of the standard hinge mounted to the sliding mechanism that allows the hinge to slide or lift when an object in encountered in the pinch area of the lid.

It is an object of the sliding safety hinge assembly to minimize the resultant force otherwise caused by the fixed nature of the hinges pivot point. The mechanism does not minimize the weight of the lid or weight imposed by the force causing the lid to close, however it does eliminate the compounding of the force and the scissors effect of the hinges pivot point. The concept is rather straightforward, the pivot point, which is traditionally fixed to the rear top surface of the box, is no longer "fixed".

It is an object of the safety hinge to manufacture the hinge in a cost effective product priced by consolidating the functions into a single assembly and the installation made simpler, saving install time & complexity, as compared to the traditional individual hardware.

It is still another object of the sliding safety hinge to be useful in numerous applications wherever a box and hinged lid assembly would be found and the desirability would be to minimize the potential severity of the traditional pinch point resulting from a "fixed" hinge. The intent would be to produce as an easy/failsafe unit assembly further reducing the craftsman or installers potential for installation error and general ease of application.

It is still another object of the sliding safety hinge assembly to use a means of offsetting the weight of the lid by means of an adjustable mechanism, such that the actual weight of the lid appears near zero resulting from gravity.

Various objects, features, aspects, and advantages of the present invention will become more apparent from the following detailed description of preferred embodiments of the invention, along with the accompanying drawings in which like numerals represent like components.

DETAILED DESCRIPTION

Figure 1:
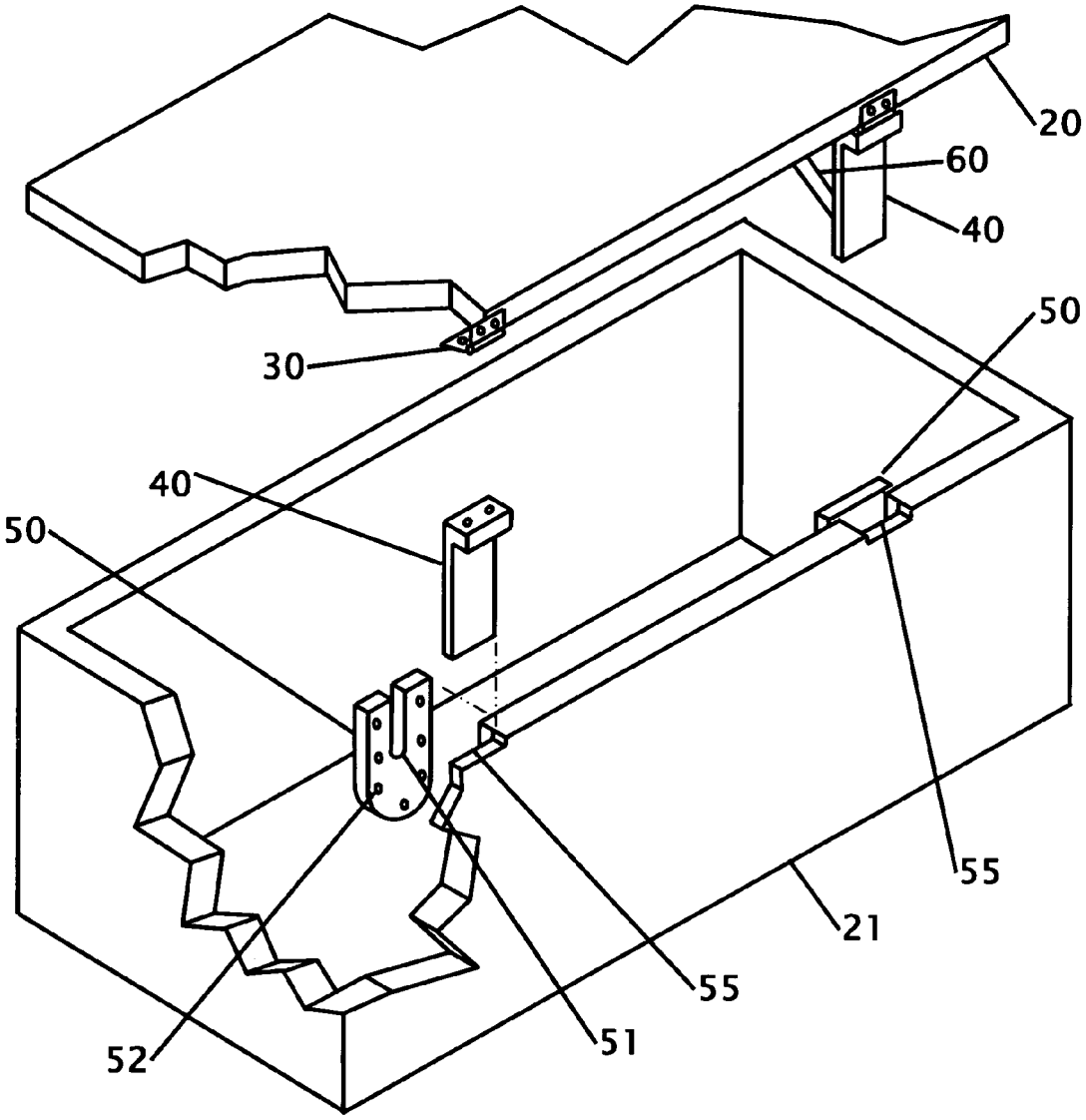
FIG. 1 shows an isometric view of the safety hinge in an exploded view on a chest.

FIG. 1 shows an isometric view of the safety hinge in an exploded view on a chest. The chest 21 includes but is not limited to a toy box, hope chest, cedar chest, window seat or storage box. The overall device capable of including the hinge's pivotal functionality, as well as a counterbalance 60 to offset the weight of the lid. The major components include two pieces of metal forming a slide, a pivot mechanism such as a hinge 30 and if desirable a counter weighting mechanism 60 to offset the weight of the lid 20 for ease of opening. The hinge 30 is a traditional hinge formed from pined, pivotal or elastomeric hinge having two linked leafs. The slide would consist of a channel section that would inherently form the female member of the assembly that would retain the male sliding element. The female portion or slot 55 would be fastened or formed to the interior wall of the "box" 21 and the male portion 40 would include the fastened hinge 30 and counter weight 60. In this figure a wide dado or slot 55 is routed into the interior upper portion of the rear panel of a toy box 21. Holes are placed around the female portion 55 perimeter for fastening of a cover 50, forming an enclosed slot with a rectangular top opening. This "slot" 55 is used to house a rectangular solid (wood) of slightly smaller dimension, such that the rectangular solid is provided freedom of sliding movement. A cover plate 50 covers the female portion 55 cut into the side of the box 21.

The cover plate 50 has a series of holes 52 for securing the cover plate 50 to the inside of the box 21 using screws or the like. A slot 51 is cut into the cover plate 50 to allow the counter weight 60 to be connected to the male portion 40. In the preferred embodiment the counter weight 60 is a spring or gas strut and may be adjustable to alter the lift force. The slot 51 is cut into the cover, such that the lid counter weighting device 60 is allowed freedom of movement in the up/down vertical plane. The counterweight 60 is fastened between the lid 20 and male element 40 of the slide assembly.

The safety hinge would be routinely used during the assembly of a box 21, such as a child's wooden toy box, hope chest, "cedar chest" and/or basically any form of box or cabinet that employs a lid, particularly a lid mounted to the top of the box that pivots on one of its edges. The safety hinge could be limited to a slide assembly only, with separate addition of a hinge 30 and counter weight 60 or rather than the intended "slide" it could be any mechanism that offers unrestrained movement in the up/down vertical plane, i.e. a dado could be routed into the box carcass and the hinge could be mounted on a bar that was free to move up and down the dado groove.

Figure 2:
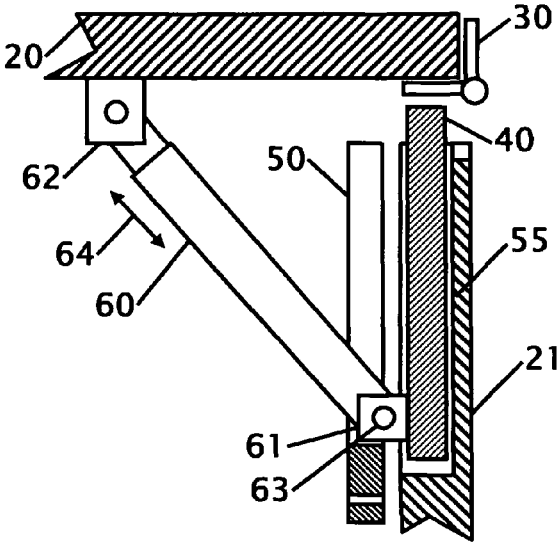
FIG. 2 shows a cross sectional view of the safety hinge on a chest.
Figure 3:
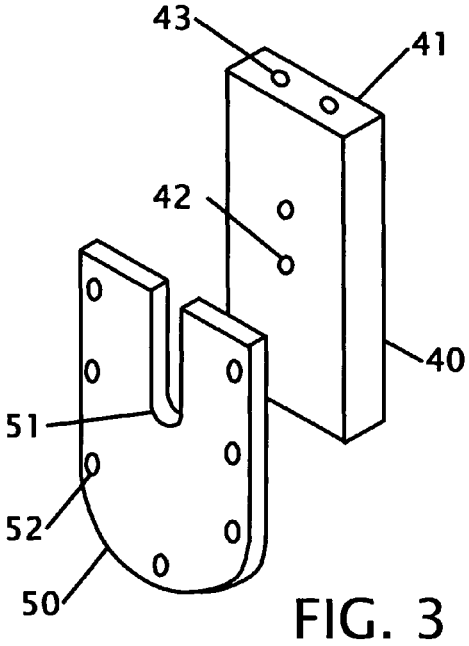
FIG. 3 shows the two unique components that create the sliding safety hinge from FIG. 2.

FIG. 2 shows a cross sectional view of the safety hinge on a chest. FIG. 3 shows the two unique components that create the sliding safety hinge from FIG. 2. The parts are shown in a slightly exaggerated and exploded view for clarity. The male element 40 of the slide (rectangular solid wood) is fastened to the rear edge of the lid 20 by using a traditional hinge 30 of leaf/pin design. The back wall of the box 21 shows the female slot 55 or recess 55. Holes 43 on the top 41 of the male element 40 are for securing the male element 40 with the hinge 30 using screws or the like. The counter weight mechanism 60 is fastened to the male element 40 of the slide and underside of lid 20.

The counterweight mechanism in the preferred embodiment offsets the weight from gravity on the lid 20 to reduce the amount of force that is required to raise the lid 20 by expanding 64. In the preferred embodiment two or more of the same male slide elements 40 are used and include hinges 30 and counter weight 60 symmetrically located. The counter weight lift mechanisms 60 have couplings 61 and 62 located on each end with pivotal connections 63 that connect to the lid 20 and the back wall of the box 21. The lid is shown in its completed form, as no further fastening to the box is required via screws or fasteners. The actual final fastening for the lid to box is solely by sliding each of the male elements into the previously described female slots 51 as shown in FIG. 1. The cover plate 50 has a series of holes 52 for securing the cover plate 50 to the inside of the box 21 using screws or the like. A slot 51 is cut into the cover plate 50 to allow the counter weight 60 to be connected to the male portion 40. The slot 51 is cut into the cover, such that the lid counter weighting device 60 is allowed freedom of movement in the up/down vertical plane.

Figure 4:
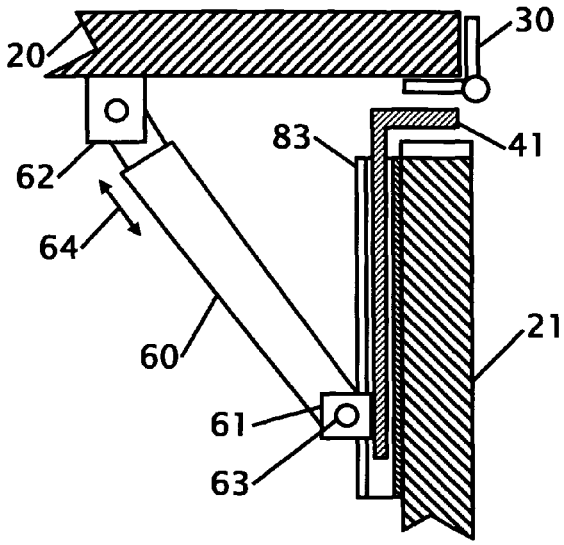
FIG. 4 shows an alternate embodiment cross sectional view of the safety hinge on a chest.
Figure 5:
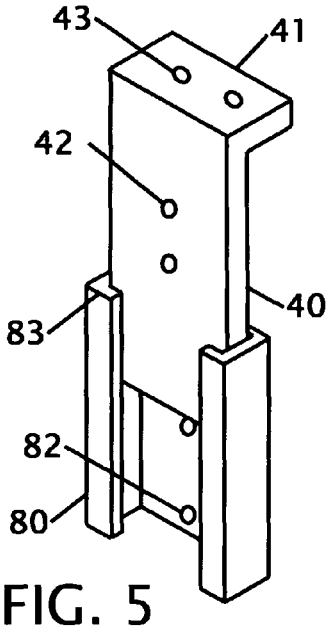
FIG. 5 shows the two unique components that create the sliding safety hinge from FIG. 4.

FIG. 4 shows an alternate embodiment cross sectional view of the safety hinge on a chest. FIG. 5 shows the two unique components that create the sliding safety hinge from FIG. 4. The parts are shown in a slightly exaggerated and exploded view for clarity. The major difference with this embodiment is that the cover plate in FIGS. 2 and 3 is replaced with a slotted "C" channel 80 that is secured to the back of the chest 21 without modification to the back wall of the chest 21. The "C" channel has bent ears 83 for securing the male element in a guided slide. The male element 40 now has a bent top 41. The male element 40 of the slide (shown as a reversed "7") is fastened to the rear edge of the lid 20 by using a traditional hinge 30 of leaf/pin design. Holes 43 on the top 41 of the male element 40 are for securing the male element 40 with the hinge 30 using screws or the like. The counter weight mechanism 60 is fastened to the male element 40 using the mounting holes 42. It is also contemplated that the engagement of the male element 40 and the "C" channel 80 is a mating dovetail interface.

The counterweight mechanism in the preferred embodiment offsets the weight from gravity on the lid 20 to reduce the amount of force that is required to raise the lid 20 by expanding 64. In the preferred embodiment two or more of the same male slide elements 40 are used and include hinges 30 and counter weight 60 symmetrically located. The counter weight lift mechanisms 60 have couplings 61 and 62 located on each end with pivotal connections 63 that connect to the lid 20 and the back wall of the box 21. The lid is shown in its completed form, as no further fastening to the box is required via screws or fasteners. The actual final fastening for the lid to box is solely by sliding each of the male elements into the previously described "C" channel slot 80. The "C" channel slot allows the male element 40 to slide within the slot and further provides clearance for the arm of the counterweight 60. The "C" channel 80 has a series of holes 82 for securing the "C" channel to the inside of the box 21 using screws or the like. The slot in "C" channel 80 is formed such that the lid counter weighting device 60 is allowed freedom of movement in the up/down vertical plane.

Figure 6:
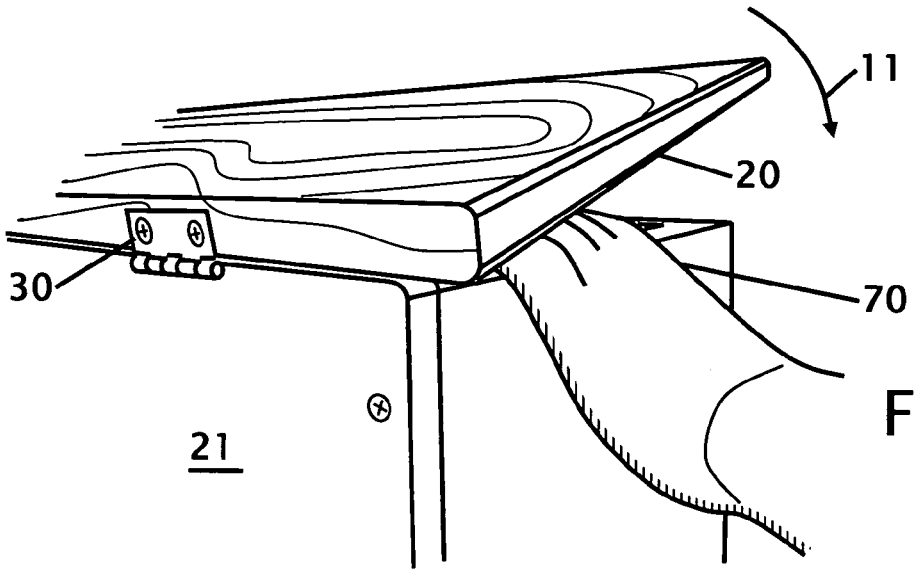
FIG. 6 shows a side view of a hand in the pinch location of a chest as the lid is being closed.
Figure 7:
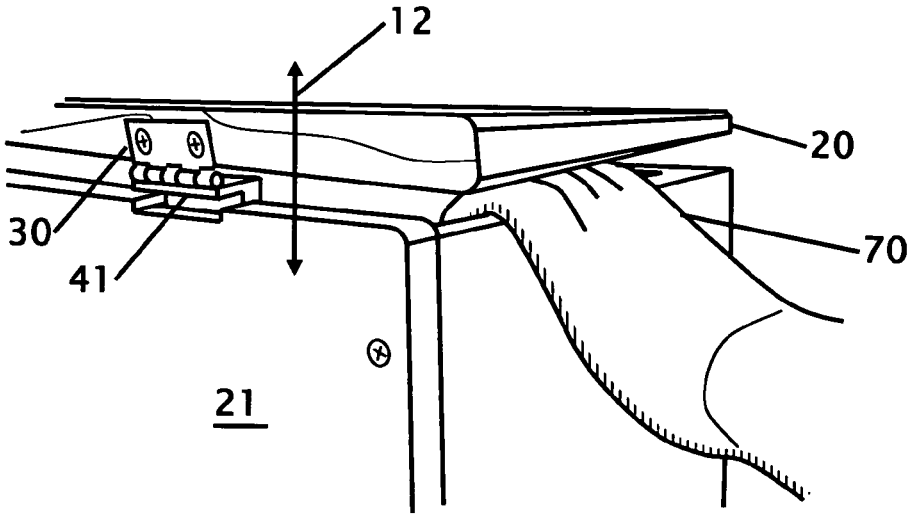
FIG. 7 shows the safety lid rising to protect the hand shown in FIG. 6.

FIG. 6 shows a side view of a hand in the pinch location of a chest as the lid is being closed. FIG. 7 shows the safety lid 20 rising to protect the hand shown in FIG. 6. In these figures a hand between the side upper edges of the box 21 and began closing 11 the lid 20 as the lid 20 pivots on hinge 30. The fingers 70 are pinched, however further closing 11 of the lid 20 results in the male element 41 began sliding and lifts upward 12 as shown in FIG. 7. The closing of the lid 20 is continued until the front edge of the lid 20 is in contact with the front edge of the box.

Thus, specific embodiments of a sliding safety hinge have been disclosed. It should be apparent, however, to those skilled in the art that many more modifications besides those described are possible without departing from the inventive concepts herein. The inventive subject matter, therefore, is not to be restricted except in the spirit of the appended claims.

What is claimed is:

1. A sliding safety hinge comprising:

a box or chest having at least two recessed pockets located in the inside upper back of said box or chest and further including a lid;

at least two rectangular male members configured to slidably engage within said at least two recessed pockets;

wherein said slidable engagement is with a dovetail interface between said male members and said at least two recessed pockets;

at least two traditional leaf hinges wherein one leaf of each said hinge is secured to a narrow end of one of two rectangular male members;

a second leaf from said hinge is secured to said lid;

a slotted cover plate that covers said rectangular male member within said recessed pocket, and a counter weight mechanism secured to said rectangular male member and said lid.

2. The sliding safety hinge according to claim 1 wherein said box or chest is a toy box, hope chest, cedar chest, window seat, storage box and has a rectangular top opening.

3. The sliding safety hinge according to claim 1 that further allows said male member to slide within said at least one of said two recessed pockets to allow said lid to lift from said box or chest when an obstruction exists between said lid and said box or chest.

4. The sliding safety hinge according to claim 1 wherein said traditional leaf hinge is pined, pivotal or elastomeric hinge having two linked leafs.

5. The sliding safety hinge according to claim 1 wherein said recessed pocked is formed from a router or milling operation.

6. The sliding safety hinge according to claim 1 wherein said counter weight offsets the weight of the lid from gravity.

7. The sliding safety hinge according to claim 1 wherein said counter weight is a spring or gas strut.

8. The sliding safety hinge according to claim 7 wherein said counter weight is adjustable for lifting force.

9. The sliding safety hinge according to claim 1 wherein said slot in said cover plate allows for clearance of said counter weight.

10. A sliding safety hinge comprising:

a box or chest having an internal cavity and a lid;

at least two elongated "C" slots configured for securing to an inside wall of said box or chest;

at least two male slide elements configured to slidably engage within said at least two elongated "C" slots;

at least two traditional leaf hinges wherein one leaf of each said hinge is secured to a bent end of one of two male slide elements;

a second leaf from said hinge is secured to said lid, and a counter weight mechanism secured to said male slide element and said lid wherein an elongated opening in said "C" slot allows for clearance of said counter weight.

11. The sliding safety hinge according to claim 10 wherein said box or chest is a toy box, hope chest, cedar chest, window seat, storage box and is rectangular is top opening.

12. The sliding safety hinge according to claim 10 that further allows said male members to slid within said at least one of said two elongated "C" slots to allow said lid to lift from said box or chest when an obstruction exists between said lid and said box or chest.

13. The sliding safety hinge according to claim 10 wherein said slidable engagement is with a dovetail interface between said male member and said two elongated "C" slots.

14. The sliding safety hinge according to claim 10 wherein said traditional leaf hinge is pined, pivotal or elastomeric hinge having two linked leafs.

15. The sliding safety hinge according to claim 10 wherein said "C" slot is secured to said box or chest with screws and said male slide elements is secured to said hinge and said counter weight with screws.

16. The sliding safety hinge according to claim 10 wherein said counter weight offsets the weight of the lid from gravity.

17. The sliding safety hinge according to claim 10 wherein said counter weight is a spring or gas strut.

18. The sliding safety hinge according to claim 17 wherein said counter weight is adjustable for lifting force.

* * * * *